US011391229B2

(12) United States Patent
Cox et al.

(10) Patent No.: US 11,391,229 B2
(45) Date of Patent: Jul. 19, 2022

(54) SYSTEM AND METHOD FOR STARTING AN ENGINE

(71) Applicant: Ford Global Technologies, LLC, Dearborn, MI (US)

(72) Inventors: David Cox, London (GB); Themi Petridis, Bishop's Stortford (GB); David Hesketh, Ingatestone (GB); Mario Balenovic, Waalre (NL); Helmut Matthias Kindl, Aachen (DE)

(73) Assignee: Ford Global Technologies, LLC, Dearborn, MI (US)

( * ) Notice: Subject to any disclaimer, the term of this patent is extended or adjusted under 35 U.S.C. 154(b) by 87 days.

(21) Appl. No.: 16/922,174

(22) Filed: Jul. 7, 2020

(65) Prior Publication Data

US 2022/0010742 A1 Jan. 13, 2022

(51) Int. Cl.

| | |
|---|---|
| ***F02D 41/06*** | (2006.01) |
| ***F01N 3/20*** | (2006.01) |
| ***F02D 41/00*** | (2006.01) |
| ***F02N 11/08*** | (2006.01) |
| ***F02B 39/10*** | (2006.01) |
| ***F02D 9/02*** | (2006.01) |
| ***F02D 9/04*** | (2006.01) |

(52) U.S. Cl.

CPC ..... *F02D 41/062* (2013.01); *F01N 3/2013* (2013.01); *F02B 39/10* (2013.01); *F02D 9/02* (2013.01); *F02D 9/04* (2013.01); *F02D 41/0077* (2013.01); *F02N 11/0807* (2013.01); *F02D 2200/50* (2013.01); *F02N 2200/0815* (2013.01)

(58) Field of Classification Search

CPC . F02D 41/062; F02D 9/02; F02D 9/04; F02D 2200/50; F02D 41/007; F01N 3/2013; F02B 39/10; F02N 11/0807; F02N 2200/0815; F02M 26/05; F02M 26/06

USPC ..... 60/278, 280, 285, 286, 605.2, 608

See application file for complete search history.

(56) References Cited

U.S. PATENT DOCUMENTS

| | | | | |
|---|---|---|---|---|
| 5,250,268 | A * | 10/1993 | Geiger | F02D 41/0255 422/177 |
| 7,159,551 | B2 | 1/2007 | Cecur et al. | |
| 7,404,383 | B2 | 7/2008 | Elendt | |
| 8,280,610 | B2 * | 10/2012 | Santoso | F01N 3/22 60/285 |
| 8,413,423 | B2 * | 4/2013 | Roos | F01N 3/2026 60/284 |
| 9,410,458 | B2 * | 8/2016 | Gonze | F01N 3/2026 |
| 9,605,603 | B2 | 3/2017 | Glugla et al. | |
| 10,301,991 | B1 | 5/2019 | Dudar | |
| 10,954,835 | B2 * | 3/2021 | Lambert | F01N 3/2066 |
| 2014/0149021 | A1 * | 5/2014 | Shimasaki | F02P 19/026 701/111 |
| 2015/0083093 | A1 * | 3/2015 | Desai | F02D 41/064 123/556 |
| 2019/0234272 | A1 | 8/2019 | Harmsen et al. | |
| 2020/0291838 | A1 * | 9/2020 | Lambert | F02D 41/405 |

* cited by examiner

*Primary Examiner* — Shafiq Mian

(74) *Attorney, Agent, or Firm* — David Kelley; McCoy Russell LLP

(57) ABSTRACT

Methods and systems for operating an engine with an electrically heated catalyst and an electrically driven compressor are described. In one example, the electrically driven compressor and the electrically heated catalyst are activated before an engine start so that vehicle emissions may be reduced more efficiently at engine starting and thereafter.

19 Claims, 4 Drawing Sheets

SYSTEM AND METHOD FOR STARTING AN ENGINE

BACKGROUND/SUMMARY

Legislated vehicle emissions levels continue to reduce allowable levels of vehicle emissions. Through considerable efforts, vehicle emissions have been significantly reduced for driving portions of vehicle operation. For example, during vehicle cruise and after engine warmup, engine emissions may be reduced substantially. As a result, opportunities to decrease vehicle emissions levels after engine warmup may be small. Therefore, efforts to reduce vehicle emissions have concentrated on reducing vehicle emissions within the first few minutes of vehicle operation. However, an engine may generate higher emissions levels just after the engine has been cold started and the vehicle's after treatment system may be less efficient during this time. Therefore, it may be desirable to provide a way of reducing vehicle emissions during such conditions.

The inventors herein have recognized the above-mentioned disadvantages and have developed an engine operating method, comprising: activating an electrically heated catalyst and opening an exhaust gas recirculation (EGR) valve in response to an indication that an engine start request is imminent.

By activating an electrically heated catalyst and opening an EGR valve, it may be possible to compound heat air circulated in an engine and engine exhaust after treatment devices so that temperatures of the after treatment devices increase at a higher rate. Further, heating of the after treatment devices via heated air may commence before an engine is started so that when the engine is started, emissions of the engine may be converted with higher efficiency.

The present description may provide several advantages. In particular, the approach may reduce vehicle emission during cold start conditions. In addition, the approach may be applied to petrol and diesel engines. Further, the approach may be provided without degrading vehicle drivability.

The above advantages and other advantages, and features of the present description will be readily apparent from the following Detailed Description when taken alone or in connection with the accompanying drawings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
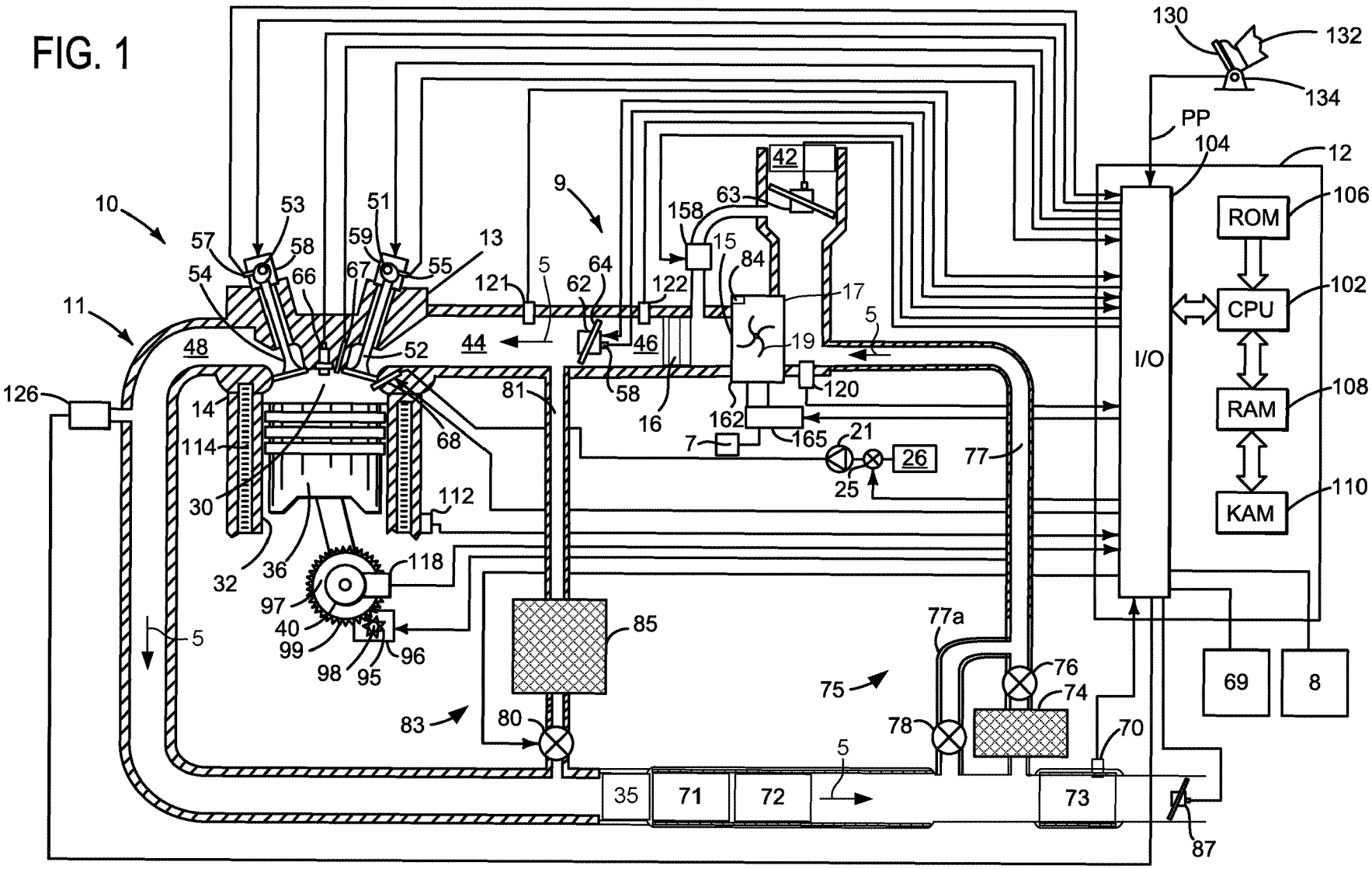
FIG. 1 shows a detailed schematic depiction of an example engine.
Figure 2:
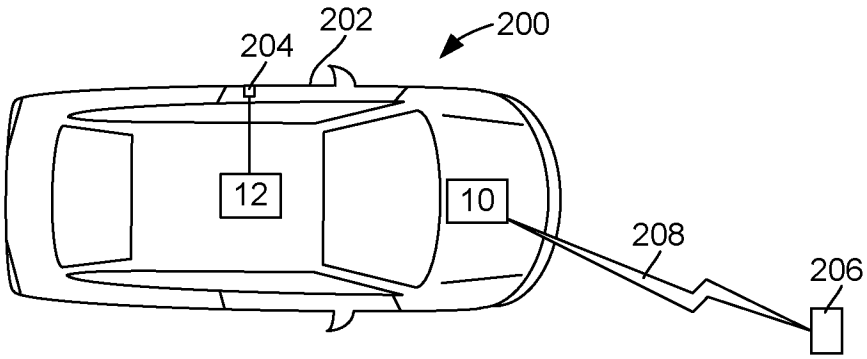
FIG. 2 shows an example vehicle that includes an engine.
Figure 3:
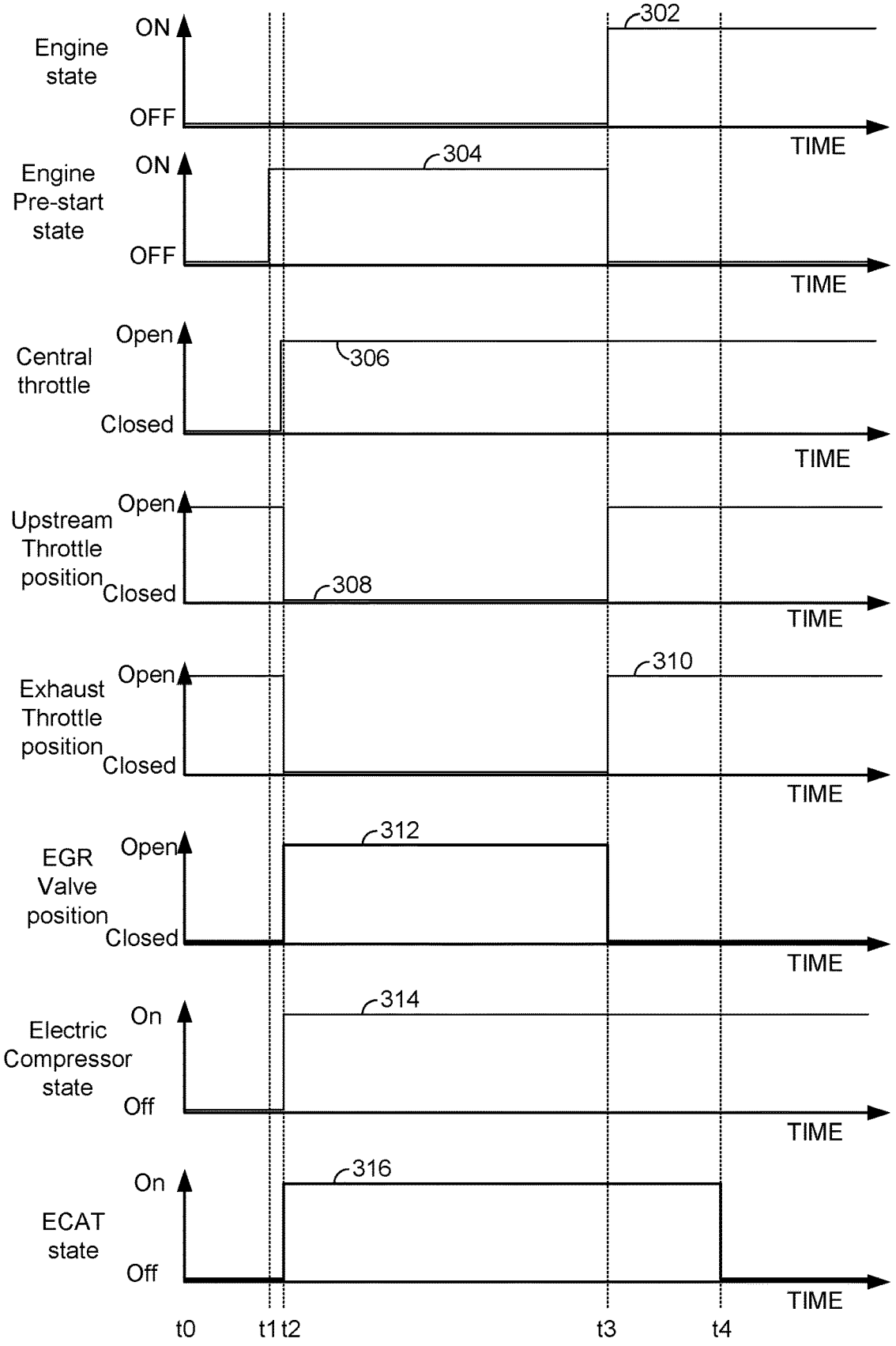
FIG. 3 shows an example vehicle operating sequence according to the present method.
Figure 4:
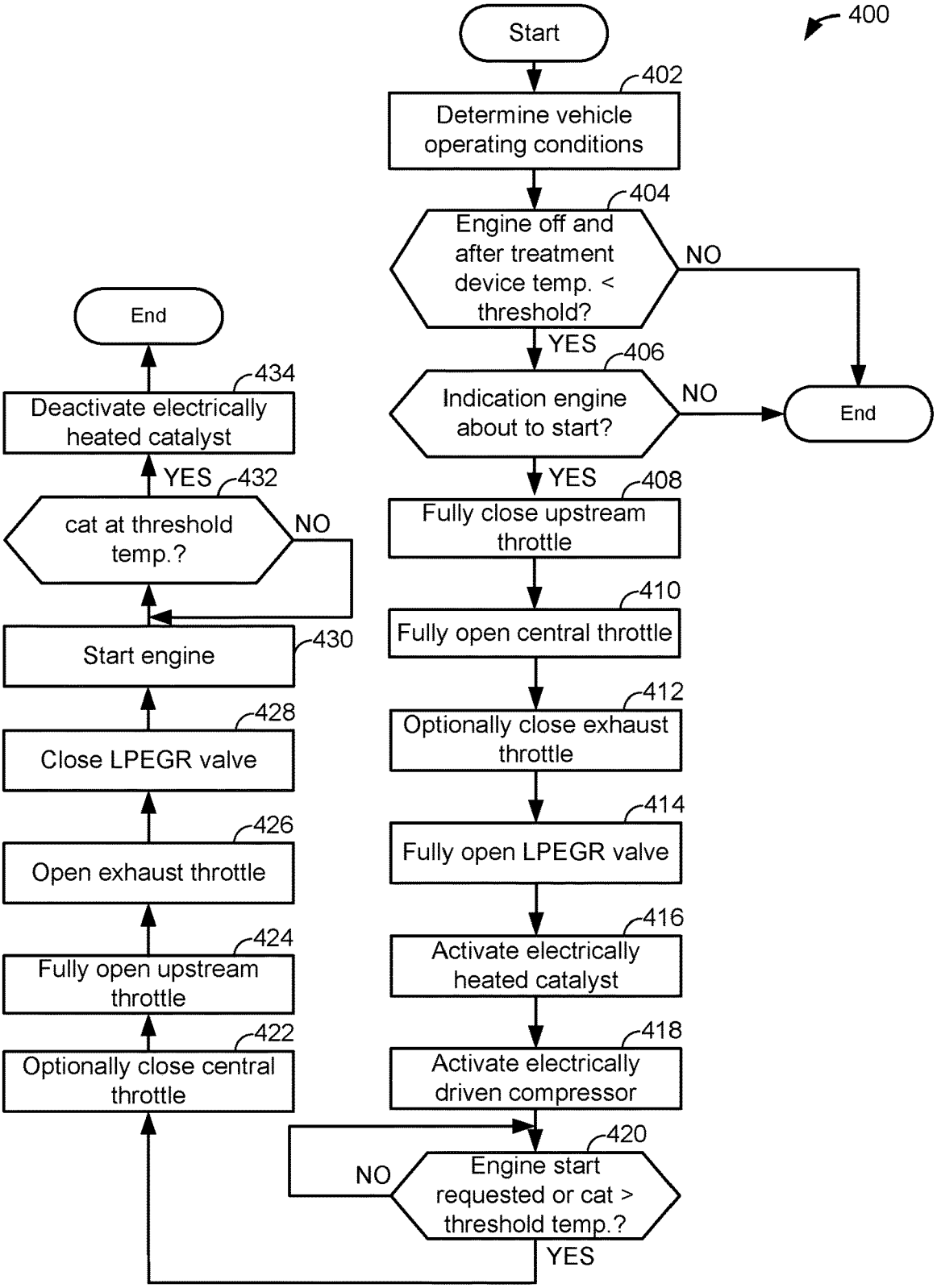
FIG. 4 shows an example method for operating a vehicle to reduce vehicle emissions.

The present description is related to operating an engine that may be cold started from time to time. FIG. 1 shows one example of an electrically boosted engine. By electrically boosting the engine, it may be possible to provide significant amounts of compressed air to the engine while the engine is not rotating so that emissions after treatment devices may be heated before an engine is started. Air flow generated by the electrically booster may be recirculated so that the air may be compound heated. In other words, the air may be heated a first time and then the air may be recirculated back to the heater to be heated again so that the temperature of the heated air increases as compared to a condition where the air is exhausted from the engine without being reheated. The air may be heated in an engine that resides in a vehicle as shown in FIG. 2. The air may be heated in a sequence as shown in FIG. 3. A method for heating the air is shown in FIG. 4.

Referring to FIG. 1, internal combustion engine 10, comprising a plurality of cylinders, one cylinder of which is shown in FIG. 1, is controlled by electronic engine controller 12. The controller 12 receives signals from the various sensors of FIG. 1 and employs the various actuators of FIG. 1 to adjust engine operation based on the received signals and instructions stored on a memory of the controller.

Engine 10 includes combustion chamber 30 and cylinder walls 32 with piston 36 positioned therein and connected to crankshaft 40. Cylinder head 13 is fastened to engine block 14. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Although in other examples, the engine may operate valves via a single camshaft or pushrods. The position of intake cam 51 may be determined by intake cam sensor 55. The position of exhaust cam 53 may be determined by exhaust cam sensor 57. Intake poppet valve 52 may be operated by a variable valve activating/deactivating actuator 59, which may be a cam driven valve operator (e.g., as shown in U.S. Pat. Nos. 9,605,603; 7,404,383; and 7,159,551 all of which are hereby fully incorporated by reference for all purposes). Likewise, exhaust poppet valve 54 may be operated by a variable valve activating/deactivating actuator 58, which may a cam driven valve operator (e.g., as shown in U.S. Pat. Nos. 9,605,603; 7,404,383; and 7,159,551 all of which are hereby fully incorporated by reference for all purposes). Intake poppet valve 52 and exhaust poppet valve 54 may be deactivated and held in a closed position preventing flow into and out of combustion chamber 30 for one or more entire engine cycles (e.g. two engine revolutions), thereby deactivating combustion chamber 30. Flow of fuel supplied to combustion chamber 30 may also cease when combustion chamber 30 is deactivated.

Fuel injector 68 is shown positioned in cylinder head 13 to inject fuel directly into combustion chamber 30, which is known to those skilled in the art as direct injection. Fuel is delivered to fuel injector 68 by a fuel system including a fuel tank 26, fuel pump 21, fuel pump control valve 25, and fuel rail (not shown). Fuel pressure delivered by the fuel system may be adjusted by varying a position valve regulating flow to a fuel pump (not shown). In addition, a metering valve may be located in or near the fuel rail for closed loop fuel control. A pump metering valve may also regulate fuel flow to the fuel pump, thereby reducing fuel pumped to a high pressure fuel pump.

Engine air intake system 9 may include an upstream throttle 63, intake manifold 44, central throttle 62, grid heater 16, turbocharger compressor 162, and air filter 42. Intake manifold 44 is shown communicating with optional central throttle 62 which adjusts a position of throttle plate 64 to control air flow from intake boost chamber 46.

Upstream throttle 63 may be operated in a similar way. Electrically driven compressor 162 draws air from air filter 42 when upstream throttle is open to supply boost chamber 46. Compressor vane actuator 84 adjusts a position of compressor vanes 19. Electric machine (e.g., motor) 165 may rotate vanes 19 to pressurize air entering engine 10. Further, an optional grid heater 16 may be provided to warm air entering combustion chamber 30 when engine 10 is being cold started. Compressor speed may be adjusted via adjusting an amount of current that is provided to electric machine 165. Compressor recirculation valve 158 allows compressed air at the outlet 15 of compressor 162 to be returned to the inlet 17 of compressor 162. Alternatively, a position of compressor variable vane actuator 78 may be adjusted to change the efficiency of compressor 162. In this way, the efficiency of compressor 162 may be increased or reduced so as to affect the flow of compressor 162 and reduce the possibility of compressor surge. Further, by returning air back to the inlet of compressor 162, work performed on the air may be increased, thereby increasing the temperature of the air. Electric machine 165 may rotate compressor 162 when engine 10 is not rotating or when engine 10 is rotating. Air flow through the engine, when the engine is not rotating before an engine cold start, is indicated in the direction of arrows 5.

Flywheel 97 and ring gear 99 are coupled to crankshaft 40. Starter 96 (e.g., low voltage (operated with less than 30 volts) electric machine) includes pinion shaft 98 and pinion gear 95. Pinion shaft 98 may selectively advance pinion gear 95 to engage ring gear 99 such that starter 96 may rotate crankshaft 40 during engine cranking. Starter 96 may be directly mounted to the front of the engine or the rear of the engine. In some examples, starter 96 may selectively supply torque to crankshaft 40 via a belt or chain. In one example, starter 96 is in a base state when not engaged to the engine crankshaft. An engine start may be requested via human/machine interface (e.g., key switch, pushbutton, remote radio frequency emitting device, etc.) 69 or in response to vehicle operating conditions (e.g., brake pedal position, accelerator pedal position, battery SOC, etc.). Low voltage battery 8 may supply electrical power to starter 96. High voltage battery 7 may supply electrical power to electric machine 165. Controller 12 may monitor battery state of charge.

Combustion is initiated in the combustion chamber 30 when fuel automatically ignites via combustion chamber temperatures reaching the auto-ignition temperature of the fuel that is injected to cylinder 30. Alternatively, in petrol engines a fuel-air mixture may be ignited via a spark plug (not shown). The temperature in the cylinder increases as piston 36 approaches top-dead-center compression stroke. In some examples, a universal Exhaust Gas Oxygen (UEGO) sensor 126 may be coupled to exhaust manifold 48 upstream of emissions device 71. In other examples, the UEGO sensor may be located downstream of one or more exhaust after treatment devices. Further, in some examples, the UEGO sensor may be replaced by a NOx sensor that has both NOx and oxygen sensing elements.

At lower engine temperatures optional glow plug 66 may convert electrical energy into thermal energy so as to create a hot spot next to one of the fuel spray cones of an injector in the combustion chamber 30. By creating the hot spot in the combustion chamber 30 next to the fuel spray, it may be easier to ignite the fuel spray plume in the cylinder, releasing heat that propagates throughout the cylinder, raising the temperature in the combustion chamber, and improving combustion. Cylinder pressure may be measured via optional pressure sensor 67, alternatively or in addition, sensor 67 may also sense cylinder temperature.

Engine exhaust gases may be processed via an exhaust system 11 that includes an electrically heated catalyst 35, which alternatively may be a heater, emissions devices, EGR passage outlets, and an exhaust throttle 87. Exhaust system 11 includes an emissions device 71 which may include an oxidation catalyst and it may be followed by a diesel particulate filter (DPF) 72 and a selective catalytic reduction (SCR) catalyst 73, in one example. In another example, DPF 72 may be positioned downstream of SCR 73. Temperature sensor 70 provides an indication of SCR temperature.

Exhaust gas recirculation (EGR) may be provided to the engine via high pressure EGR system 83. High pressure EGR system 83 includes valve 80, EGR passage 81, and EGR cooler 85. EGR valve 80 is a valve that closes or allows exhaust gas to flow from upstream of emissions device 71 to a location in the engine air intake system downstream of compressor 162. EGR may be cooled via passing through EGR cooler 85. EGR may also be provided via low pressure EGR system 75. Low pressure EGR system 75 includes EGR passage 77 and EGR valve 76. Low pressure EGR may flow from downstream of emissions device 71 to a location upstream of compressor 162. Low pressure EGR system 75 may include an EGR cooler 74, a cooler bypass passage **77*a*, and a low pressure cooler bypass valve 78. Low pressure cooler bypass valve 78 may be opened for gases to bypass cooler 74. Exhaust throttle 87** may be opened when the engine is running and it may be fully closed when the engine is not rotating while emissions devices are being heated.

Controller 12 is shown in FIG. 1 as a conventional microcomputer including: microprocessor unit 102, input/output ports 104, read-only memory (e.g., non-transitory memory) 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to an accelerator pedal 130 for sensing accelerator position adjusted by human foot 132; a measurement of engine manifold pressure (MAP) from pressure sensor 121 coupled to intake manifold 44 (alternatively or in addition sensor 121 may sense intake manifold temperature); boost pressure from pressure sensor 122 exhaust gas oxygen concentration from oxygen sensor 126; an engine position sensor from a Hall effect sensor 118 sensing crankshaft 40 position; a measurement of air mass entering the engine from sensor 120 (e.g., a hot wire air flow meter); and a measurement of throttle position from sensor 58. Barometric pressure may also be sensed (sensor not shown) for processing by controller 12. In a preferred aspect of the present description, engine position sensor 118 produces a predetermined number of equally spaced pulses every revolution of the crankshaft from which engine speed (RPM) can be determined.

During operation, each cylinder within engine 10 typically undergoes a four stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In some examples, fuel may be injected to a cylinder a plurality of times during a single cylinder cycle.

In a process hereinafter referred to as ignition, the injected fuel is ignited by compression ignition resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples. Further, in some examples a two-stroke cycle may be used rather than a four-stroke cycle.

Referring now to FIG. 2, engine 10 is shown included within vehicle 200. A vehicle door position sensor 204 provides an indication of a position of vehicle door 202 to controller 12. Controller 12 may use a door position indication that is provided by door position sensor 204 to pre-heat after treatment devices (e.g., 71 and 72 shown in FIG. 1). In particular, controller 12 may activate an electrically heated catalyst or a heater when engine 10 is not rotating in response to an indication of an open door. In addition, controller 12 may activate an electrically heated catalyst or a heater when engine 10 is not rotating in response to a signal from a remote device 206. Remote device (e.g., key fob, phone, tablet, etc.) may transmit a signal 208 that it is desired to start engine 10 or that a vehicle operator is proximate to the location of vehicle 200, which may be indicative of a pending engine start.

The system of FIGS. 1 and 2 provides for an engine system, comprising: a diesel engine including an electrically driven compressor, a low pressure exhaust gas recirculation (EGR) valve, and an exhaust system including an electrically heated catalyst; and a controller including executable instructions stored in non-transitory memory that cause the controller to open the low pressure EGR valve, activate the electrically driven compressor, and activate the electrically heated catalyst in response to an indication that a start of the diesel engine is imminent. The engine system further comprises additional instructions to close the low pressure EGR valve in response to a request to start the engine. The engine system further comprises an upstream throttle and a central throttle. The engine system further comprises additional instructions to fully close the upstream throttle and fully open the central throttle in response to the indication that the start of the diesel engine is imminent. The engine system further comprises additional instructions to fully open the upstream throttle in response to an engine start request. The engine system further comprises additional instructions to not open the EGR valve in response to less a battery state of charge being less than a threshold.

Referring now to FIG. 3, an example prophetic engine operating sequence for an engine is shown. The operating sequence of FIG. 3 may be produced via the system of FIG. 1 executing instructions of the method described in FIG. 4. The plots of FIG. 3 are aligned in time and occur at the same time. Vertical markers at t0-t4 indicate times of particular interest during the sequence.

The first plot from the top of FIG. 3 represents engine state versus time. Trace 302 represents engine state and the engine is off when trace 302 is at a low level near the horizontal axis. The engine is on and receiving fuel combusting the fuel or at least attempting to combust the fuel via compression ignition when trace 302 is at a higher level near the vertical axis arrow. The vertical axis represents engine state. The horizontal axis represents time and time increases from the left side to right side of the figure.

The second plot from the top of FIG. 3 represents an engine pre-start state versus time. Trace 304 represents the engine pre-start state. The vertical axis represents engine pre-start state and an engine pre-start is active when trace 304 is at a higher level near the vertical axis arrow. The engine pre-start is not active when trace 304 is at a lower level near the horizontal axis. The engine pre-start sequence may include activating an electrically heated catalyst, adjusting engine throttles, activating a compressor, and adjusting a position of an exhaust gas recirculation (EGR) valve. The pre-start sequence may heat up one or more exhaust after treatment devices in preparation for an impending engine start so that engine emissions may be converted sooner, thereby reducing tailpipe emissions. The horizontal axis represents time and time increases from the left side to right side of the figure.

The third plot from the top of FIG. 3 represents an operating state of the engine's central throttle versus time. Trace 306 represents the operating state of the central throttle. The vertical axis represents the state of the central throttle and the central throttle is open when trace 306 is at a higher level near the vertical axis arrow. The central throttle is fully closed when trace 306 is at a lower level near the horizontal axis. The horizontal axis represents time and time increases from the left side to right side of the figure.

The fourth plot from the top of FIG. 3 represents an operating state of the engine's upstream throttle versus time. Trace 308 represents the operating state of the upstream throttle. The vertical axis represents the state of the upstream throttle and the upstream throttle is open when trace 308 is at a higher level near the vertical axis arrow. The upstream throttle is fully closed when trace 308 is at a lower level near the horizontal axis. The horizontal axis represents time and time increases from the left side to right side of the figure.

The fifth plot from the top of FIG. 3 represents an operating state of the engine's exhaust throttle versus time. Trace 310 represents the operating state of the exhaust throttle. The vertical axis represents the state of the exhaust throttle and the exhaust throttle is open when trace 310 is at a higher level near the vertical axis arrow. The exhaust throttle is fully closed when trace 310 is at a lower level near the horizontal axis. The horizontal axis represents time and time increases from the left side to right side of the figure.

The sixth plot from the top of FIG. 3 represents an operating state of the engine's EGR valve versus time. Trace 312 represents the operating state of the EGR valve. The vertical axis represents the state of the EGR valve and the EGR valve is open when trace 312 is at a higher level near the vertical axis arrow. The EGR valve is fully closed when trace 312 is at a lower level near the horizontal axis. The horizontal axis represents time and time increases from the left side to right side of the figure.

The seventh plot from the top of FIG. 3 represents an operating state of the engine's electrically driven compressor versus time. Trace 314 represents the operating state of the electrically driven compressor. The vertical axis represents the state of the electrically driven compressor and the electrically driven compressor is activated or "ON" (e.g., rotating and compressing air) when trace 314 is at a higher level near the vertical axis arrow. The electrically driven compressor is deactivated of "OFF" when trace 314 is at a lower level near the horizontal axis. The horizontal axis represents time and time increases from the left side to right side of the figure.

The eighth plot from the top of FIG. 3 represents an operating state of the electrically heated catalyst versus time. Trace 316 represents the operating state of the electrically heated catalyst. The vertical axis represents the state of the electrically heated catalyst and the electrically heated catalyst is activated or "ON" (e.g., being electrically heated) when trace 316 is at a higher level near the vertical axis arrow. The electrically heated catalyst is deactivated or "OFF" when trace 316 is at a lower level near the horizontal axis. The horizontal axis represents time and time increases from the left side to right side of the figure.

At time t0, the engine is stopped (not combusting and not rotating) and engine pre-starting is not asserted. The central throttle is fully closed and the upstream throttle is fully open. The exhaust throttle is fully open and the EGR valve is fully closed. The electrically driven compressor is deactivated and the electrically heated catalyst (ECAT) is not activated. Such conditions may be present when the engine is not running.

At the time t1, the engine pre-starting is asserted and the engine is not activated. The engine pre-starting may be asserted via a vehicle door being opened or via a signal from a remote device. The central throttle remains closed and the upstream throttle is fully open. The exhaust valve is fully open and the EGR valve is fully closed. The electrically driven compressor is not activated and the electrically heated catalyst is not activated.

At time t2, the engine pre-starting remains asserted and the engine is not activated. The central throttle is fully opened and the upstream throttle is fully closed in response to the pre-starting request. The exhaust valve is fully closed and the EGR valve is fully opened in response to the pre-starting request. The electrically driven compressor is activated and the electrically heated catalyst is activated in response to the pre-starting request. By closing the upstream throttle, closing the exhaust throttle, and opening the EGR valve, air may be pumped via the electrically driven compressor and repeatedly be recirculated back to the compressor. Thus, the same air may be heated and reheated via the compressor and the electrically heated catalyst. This operation may be referred to as compound heating of the air and it may increase temperatures of exhaust after treatment devices higher than if the air where only heated once and then ejected out of the vehicle's tailpipe.

At time t3, the engine is started and the pre-start state is exited. The engine may be started via input from a human driver/occupant or automatically. The central throttle remains fully open since this example is for a diesel engine; however, the central throttle may be fully closed at the time of engine start for petrol engines. The upstream throttle is fully opened and the exhaust throttle is fully opened in response to the engine start. Further, the EGR valve is fully closed in response to the engine start. The electrically drive compressor remains activated and the electrically heated catalyst remains activated.

At time t4, the engine is operating and the pre-start state is not asserted. The central throttle remains fully open and the upstream throttle is fully opened. The exhaust throttle remains fully opened and the EGR valve is fully closed. The electrically drive compressor remains activated and the electrically heated catalyst is deactivated in response to the catalyst reaching a threshold temperature.

In this way, pre-heating of exhaust system after treatment devices may be provided so that engine tailpipe emissions may be reduced. In addition, air within the engine may be heated several times during a pre-starting sequence so that after treatment device temperature may increase.

Referring now to FIG. 4, a method for operating an engine is shown. In particular, a flowchart of a method for operating an internal combustion engine is shown. The method of FIG. 4 may be stored as executable instructions in non-transitory memory in systems such as shown in FIGS. 1 and 2. The method of FIG. 4 may be incorporated into and may cooperate with the systems of FIGS. 1 and 2. Further, at least portions of the method of FIG. 4 may be incorporated as executable instructions stored in non-transitory memory while other portions of the method may be performed via a controller transforming operating states of devices and actuators in the physical world. The controller may employ engine actuators of the engine system to adjust engine operation, according to the method described below. Further, method 400 may determine selected control parameters from sensor inputs.

At 402, method 400 determines vehicle operating conditions. Vehicle operating conditions may include but are not limited to engine temperature, accelerator pedal position, ambient temperature, engine starting requests, ambient pressure, driver demand torque, and engine speed. Vehicle operating conditions may be determined via vehicle sensors and the engine controller described in FIG. 1. Method 400 proceeds to 404.

At 404, method 400 judges if the engine is off (e.g., not rotating and combusting fuel) and a temperature of an exhaust after treatment device start is less than a threshold temperature (e.g., a catalyst light off temperature). If method 400 judges that the engine is off and the temperature of the exhaust after treatment device is less than the threshold temperature, the answer is yes and method 400 proceeds to 406. Otherwise, the answer is no and method 400 proceeds to exit. Method 400 may continue operating the engine in its present state if the answer is no.

At 406, method 400 judges if there is an indication that the engine may be started in the near future. Method 400 may judge that there is an indication that the engine may be started in the near future if the vehicle's door is open or has been opened within a predetermined time. Method 400 may also judge that there is an indication that the engine may be started if the vehicle receives a signal to start the engine, prepare the engine for starting, or if a remote device has entered in close proximity to the vehicle (e.g., within 10 meters). If method 400 judges that there is an indication that the engine may start, the answer is yes and method 400 proceeds to 408. Otherwise, the answer is no and method 400 proceeds to exit. Method 400 may continue operating the engine in its present state if the answer is no.

At 408, method 400 may optionally fully close an upstream throttle, if an upstream throttle is present within the vehicle. By fully closing the upstream throttle, air may be recirculated from the compressor, through the engine, through the engine's exhaust system and EGR passage before returning back to the compressor. Fully closing the upstream throttle may prevent air from exiting the engine via the engine's air intake passage. Method 400 proceeds to 410.

At 410, method 400 fully opens a central throttle, if a central throttle is present within the vehicle. By fully opening the central throttle, air may pass from the compressor and through the engine's cylinders where intake and exhaust valves may be simultaneously open. In addition, intake and exhaust poppet valves of one or more cylinders may be opened to allow air flow through the engine's cylinders if intake and exhaust valve overlap is small. The poppet valve may be opened via a decompression control device or via variable valve actuators. Alternatively, or in addition, method 400 may open a high pressure EGR valve (e.g., 80) to direct air around engine 10 and to electrically heated catalyst 35. In such cases, the air may also be directed around an EGR cooler, if present. Method 400 proceeds to 412.

At 412, method 400 may optionally fully close an exhaust throttle, if an exhaust throttle is present within the vehicle. By fully closing the exhaust throttle, air may be returned to the compressor without flowing from the exhaust system so that the air may be reheated. Reheating the air may increase after treatment device temperatures and reduce an amount of energy used to heat the after treatment device. Method 400 proceeds to 414.

At 414, method 400 fully opens a low pressure EGR valve (e.g., 78 of FIG. 1). By fully opening the low pressure EGR valve, air may be returned from the engine's exhaust manifold to the engine's compressor without flowing from the exhaust system so that the air may be reheated. Method 400 proceeds to 416.

At 416, method 400 activates the electrically heated catalyst (e.g., 35 of FIG. 1). By activating the electrically heated catalyst, a temperature of the catalyst and other after treatment devices may be increased, thereby increasing their efficiencies. Method 400 proceeds to 418.

At 418, method 400 activates the electrically driven compressor (e.g., 162 of FIG. 1). By activating the electrically driven compressor, heated air may be continuously be recirculated in the engine before the engine is started and rotating. Method 400 proceeds to 420.

At 420, method 400 judges if an engine start is requested or if a temperature of an after treatment device is greater than a threshold temperature. Method 400 may judge that there is an engine start request if a human driver requests an engine start or of there is a request to start the engine automatically. If method 400 judges that there is an indication that the engine may be started in the near future. Method 400 may judge that an engine start is requested or that a temperature of an after treatment device is greater than a threshold, then the answer is yes and method 400 proceeds to 422. Otherwise, the answer is no and method 400 returns to 420.

At 422, method 400 optionally fully closes the central throttle. If the engine is a diesel engine, the central throttle may be held fully or partially open. If the engine is a petrol engine, the central throttle may be fully closed so that engine torque may be controlled. Method 400 proceeds to 424.

At 424, method 400 fully opens the upstream throttle. The upstream throttle is fully opened to allow fresh air to enter the engine. Method 400 proceeds to 426.

At 426, method 400 fully opens the exhaust throttle. The exhaust throttle is fully opened to allow exhaust to exit the engine. Method 400 proceeds to 428.

At 428, method 400 fully closed the low pressure EGR valve. The low pressure EGR valve is fully closed to reduce charge dilution during engine starting so that engine starting may be improved. Method 400 proceeds to 430.

At 430, method 400 starts the engine. The engine may be started via rotating the engine via a starter and supplying fuel to the engine. Method 400 proceeds to 432.

At 432, method 400 judges if a temperature of a catalyst is greater that a threshold temperature (e.g., a catalyst light off temperature). If so, method 400 proceeds to 434. Otherwise, method 400 returns to 432. In this way, the electrically heated catalyst may continue to heat the after treatment devices so that emissions reductions may be provided.

At 434, method 400 deactivates the electrically heated catalyst to reduce power consumption. Method 400 proceeds to exit.

In this way, warm air may be circulated within an engine and the engine's exhaust system to warm after treatment devices sooner. By warming the after treatment devices sooner, engine emissions may be reduced sooner.

In some examples, method 400 may heat after treatment devices without compound heating of the air. For example, method 400 may activate the electrically heated catalyst, activate the compressor and flow air to the exhaust passage, open the high pressure EGR valve and/or engine poppet valves, close the low pressure EGR valve, open the exhaust throttle, open the central throttle, and open the upstream throttle. Thus, fresh air may flow from the engine intake to the electrically heated catalyst and from the electrically heated catalyst to other after treatment devices.

Thus, method 400 provides for an engine operating method, comprising: activating an electrically heated catalyst and opening an exhaust gas recirculation (EGR) valve in response to an indication that an engine start request is imminent. The engine method includes where the indication that the engine start request is imminent is provided via a vehicle door position sensor. The engine method includes where the indication that the engine start request is imminent is provided via a device that is remote from a vehicle, the device transmitting a signal. The engine method further comprises closing an exhaust throttle in response to the indication that the engine start request is imminent. The engine method includes where the EGR valve is fully opened and where the EGR valve is a low pressure EGR valve. The engine method further comprises activating an electrically driven compressor in response to the indication that the engine start request is imminent. The engine method further comprises closing the EGR valve in response to an engine start request. The engine method further comprises opening an exhaust throttle in response to the engine start request, the exhaust throttle positioned in an exhaust system downstream of an emissions control device.

Method 400 also provides for an engine operating method, comprising: activating an electrically heated catalyst, opening an exhaust gas recirculation (EGR) valve, and closing an upstream throttle in response to an indication that an engine start request is imminent. The engine method includes where the upstream throttle is fully closed. The engine method further comprises opening a central throttle in response to the indication that the engine start request is imminent. The engine method further comprises fully opening the upstream throttle and closing the EGR valve in response to a request to start the engine. The engine method further comprises closing an exhaust throttle in response to the indication that the engine start request is imminent. The engine method further comprises not activating an electrically heated catalyst, not opening an exhaust gas recirculation (EGR) valve, and not closing an upstream throttle in response to the indication that the engine start request is imminent and battery state of charge being less than a threshold.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. Further, portions of the methods may be physical actions taken in the real world to change a state of a device. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller. One or more of the method steps described herein may be omitted if desired.

It will be appreciated that the configurations and routines disclosed herein are exemplary in nature, and that these specific examples are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An engine operating method, comprising:

activating an electrically heated catalyst and opening an exhaust gas recirculation (EGR) valve via a controller in response to an indication that an engine is about to start; and closing an exhaust throttle in response to the indication that the engine is about to start.

2. The engine method of claim 1, where the indication that the engine is about to start is provided via a vehicle door position sensor.

3. The engine method of claim 1, where the indication that the engine is about to start is provided via a device that is remote from a vehicle, the device transmitting a signal.

4. The engine method of claim 1, where the EGR valve is fully opened and where the EGR valve is a low pressure EGR valve.

5. The engine method of claim 1, further comprising activating an electrically driven compressor in response to the indication that the engine is about to start.

6. The engine method of claim 1, further comprising closing the EGR valve in response to an engine start request.

7. The engine method of claim 6, further comprising opening an exhaust throttle in response to the engine start request, the exhaust throttle positioned in an exhaust system downstream of an emissions control device.

8. An engine system, comprising:

a diesel engine including an electrically driven compressor, a low pressure exhaust gas recirculation (EGR) valve, and an exhaust system including an electrically heated catalyst; and a controller including executable instructions stored in non-transitory memory that cause the controller to open the low pressure EGR valve, activate the electrically driven compressor, and activate the electrically heated catalyst in response to an indication that the diesel engine is about to start.

9. The engine system of claim 8, further comprising additional instructions to close the low pressure EGR valve in response to a request to start the engine.

10. The engine system of claim 8, further comprising an upstream throttle and a central throttle.

11. The engine system of claim 10, further comprising additional instructions to fully close the upstream throttle and fully open the central throttle in response to the indication that the start of the diesel engine is imminent.

12. The engine system of claim 11, further comprising additional instructions to fully open the upstream throttle in response to an engine start request.

13. The engine system of claim 8, further comprising additional instructions to not open the low pressure EGR valve in response to less a battery state of charge being less than a threshold.

14. An engine operating method, comprising:

activating an electrically heated catalyst, opening a low pressure exhaust gas recirculation (EGR) valve, and closing an upstream throttle via a controller in response to an indication that an engine is about to start.

15. The engine method of claim 14, where the upstream throttle is fully closed.

16. The engine method of claim 15, further comprising opening a central throttle in response to the indication that the engine start request is imminent.

17. The engine method of claim 16, further comprising fully opening the upstream throttle and closing the low pressure EGR valve in response to a request to start the engine.

18. The engine method of claim 17, further comprising closing an exhaust throttle in response to the indication that the engine start request is imminent.

19. The engine method of claim 14, further comprising not activating the electrically heated catalyst, not opening the low pressure exhaust gas recirculation (EGR) valve, and not closing the upstream throttle in response to the indication that the engine start request is imminent and battery state of charge being less than a threshold.

* * * * *